United States Patent [19]

Anderson et al.

[11] Patent Number: 4,552,230

[45] Date of Patent: Nov. 12, 1985

[54] DRILL STRING SHOCK ABSORBER

[76] Inventors: Edwin A. Anderson; Derrel D. Webb, both of P.O. Box 567, Houston, Tex. 77001

[21] Appl. No.: 598,703

[22] Filed: Apr. 10, 1984

[51] Int. Cl.[4] ..... E21B 17/07

[52] U.S. Cl. ..... 175/321; 267/125; 464/20

[58] Field of Search ..... 175/321, 297, 299; 464/20, 21, 18; 267/125, 137; 166/178, 301

[56] References Cited

U.S. PATENT DOCUMENTS

| | | | |
|---|---|---|---|
| 3,073,134 | 1/1963 | Mann | 64/23 |
| 3,225,566 | 12/1965 | Leathers | 464/18 |
| 3,329,221 | 7/1967 | Walker | 175/321 |
| 3,382,936 | 5/1968 | Galle | 175/321 |
| 3,947,008 | 3/1976 | Mullins | 267/137 |
| 3,963,228 | 6/1976 | Karle | 267/166 |
| 4,054,040 | 10/1977 | Medders | 175/321 |
| 4,133,516 | 1/1979 | Jürgens | 175/321 |
| 4,162,619 | 7/1979 | Nixon | 175/321 X |
| 4,173,130 | 11/1979 | Sutliff et al. | 175/321 X |
| 4,186,569 | 2/1979 | Aumann | 175/321 X |
| 4,194,582 | 3/1980 | Ostertag | 175/321 |
| 4,210,316 | 7/1980 | Hall | 267/125 |
| 4,211,290 | 7/1980 | Mason et al. | 175/321 |
| 4,257,245 | 3/1981 | Toelke et al. | 175/321 X |
| 4,303,138 | 12/1981 | Bassinger | 175/296 |
| 4,398,898 | 8/1983 | Odom | 175/321 |
| 4,434,863 | 3/1984 | Garrett | 175/321 |

FOREIGN PATENT DOCUMENTS

| | | | |
|---|---|---|---|
| 2025490 | 1/1980 | United Kingdom | 175/321 |

OTHER PUBLICATIONS

"OSG-3 Oil Packed Pressure Balanced Bumper Sub", Dec. 27, 1966.

*Primary Examiner*—Stephen J. Novosad
*Assistant Examiner*—Hoang C. Dang
*Attorney, Agent, or Firm*—Jack W. Hayden

[57] ABSTRACT

A telescopic shock absorber for use in a drill string includes a resilient arrangement to cushion telescopic contraction and extension of the shock absorber in response to shock loads and vibrations imparted during drilling. The shock absorber operates independently of the drilling fluid pressure conducted through the structure during drilling operations. A dampening system assists in cushioning the shock loads and vibrations and the dampening system and resilient arrangement are deactivated when jarring impacts are delivered to the well string by a drilling jar carried therein. The resilient arrangement provides a combination mechanical and hydraulic system for cushioning the impact loads and vibrations encountered.

18 Claims, 10 Drawing Figures

DRILL STRING SHOCK ABSORBER

BACKGROUND OF THE INVENTION

1. Field of the Invention

The present invention relates to a well string shock absorber wherein an inner member and an outer housing form a telescopic structure with resilient means engageable between the body and housing to cushion telescopic contraction and extension of the inner body and outer housing in response to loads and vibrations encountered during drilling.

2. Description of the Prior Art

Various types of drill string shock absorbers have been provided in the past and are currently in use. As the drill bit which is connected to the drill string is rotated to cause penetration of the bit through the earth formation, the bit may tend to jump off the bottom of the hole being drilled which imparts shock loads to the drill string and also may result in reduced penetration rate of the bit and drill string through the formation. Drilling fluid is circulated downwardly through the drill string and through the bit for a number of reasons including carrying cuttings from the bottom of the well bore to the earth's surface.

Heretofore, it has been recognized that shock absorbing mechanisms are responsive to the pump pressure acting to move the drilling fluid down to the bottom of the well bore and back up to the earth's surface. For example, see U.S. Letters Pat. Nos. 4,186,569 and 4,194,582 issued on Feb. 5, 1979 and Mar. 25, 1980, respectively. More particularly, the drilling fluid pressure acting on the lower end of the inner body of prior art telescopic shock absorber structures tends to urge the inner body upwardly relative to the outer housing. In some circumstances, this can be extremely undesirable in that the pressure may be sufficient to fully extend the outer housing and inner body and the telescopic structure is thus rigid unless the weight of the drill string is sufficient to overcome the hydraulic force tending to extend the inner body and outer housing of the telescopic structure to their extreme limits.

For various reasons it is undesirable to have a shock absorbing tool in a drill string which cannot function independently of the pump pressure, or of the pressure of the drilling fluid passing through the telescopic structure since the operating range of the shock absorber may be limited, and may not operate effectively and properly under all conditions as desired.

Further, prior art shock absorbers provide stop shoulder means which limits the extension and contraction of the inner body and outer housing forming the telescopic structure, and such stop shoulder means generally have either one or both of such stop shoulder means arranged on the telescopic structure in the liquid receiving chamber in which the spring means or resilient means is provided.

Quite often in drilling a well bore a drilling jar is employed in the drill string to impart a jar impact up and/or down as may be desired from time to time in the event that the drill string becomes stuck. The prior art positions one or more of the shoulder stop means in the chamber in which the resilient or spring means is provided along with liquid, and such structure may cause substantial forces to be imparted to the shock absorber mechanism when the drilling jar is actuated which may damage if not completely destroy the shock absorber mechanism.

Also, the prior art provides restricted passages to dampen the loads and vibrations and to dampen the relative movement between the shock absorber components. However, this continuous dampening ability substantially prevents deactivation of prior art devices when drilling jar loads or impacts are applied thereto which may damage the shock absorber components.

While Belleville springs have been employed as the resilient means in shock absorber tools, they have not been structured to trap liquid therein as they are compressed to provide additional load carrying ability.

SUMMARY OF THE INVENTION

An object of the present invention is to minimize, if not substantially eliminate, the pump loading effect in a telescopic structure shock absorber arrangement by balancing or neutralizing the effect of the pump.

Another object of the present invention is to provide a telescopic shock absorber structure including an inner body and an outer housing which are provided with stop shoulder means to limit the extent of contraction and extension between the inner body and outer housing, such stop shoulder means being located completely externally, or outside, of the fluid receiving chamber in which the resilient spring means is received to cushion shock loads and vibrations.

Yet a further object of the present invention is to space the stop shoulder means on an elongated telescopic structure having an inner body and an outer housing so that the stop shoulder means which limits the extension and the stop shoulder means which limits the contraction between the inner body and the outer housing will first engage before a drilling jar applies either an up jar impact or a down jar impact to the drill string in which the shock absorber and drilling jar are carried.

Still another object of the present invention is to provide a shock absorber structure including an inner member and an outer housing with seal means therebetween to define a liquid receiving chamber for receiving a resilient means therein, and means within the chamber to dampen shock loads and vibrations imparted to the structure encountered during drilling of a well bore.

Yet another object of the present invention is to provide a shock absorber structure including an inner member and an outer housing with seal means therebetween to define a liquid receiving chamber for receiving a resilient means therein, and means within the chamber to dampen shock loads and vibrations imparted to the structure encountered during drilling of a well bore and means to deactivate the dampening means when a drilling jar in the drill string is actuated to impart upward and downward jar impacts to the drill string to inhibit damage to the shock absorber.

Yet a further object of the present invention is to provide in a telescopic structure including an inner body and an outer housing which forms a shock absorber for a drill string in a well bore, and wherein seals are provided between the inner body and outer housing to form a liquid receiving chamber in which is mounted a resilient means, the resilient means including a spring arrangement which is constructed and arranged to trap liquid to resist discharge of the liquid through the spring means upon contraction thereof which imparts further load carrying ability to the spring means and thereby further assists in cushioning shock loads and vibrations imparted to the structure during drilling operations.

Other objects and advantage of the present invention will become apparent from a consideration of the following drawings and description.

BRIEF DESCRIPTION OF THE DRAWINGS

FIG. 7 illustrates the present invention located in a drilling string when employed with stabilizers and the like.

DESCRIPTION OF THE PREFERRED EMBODIMENTS

Figure 1:
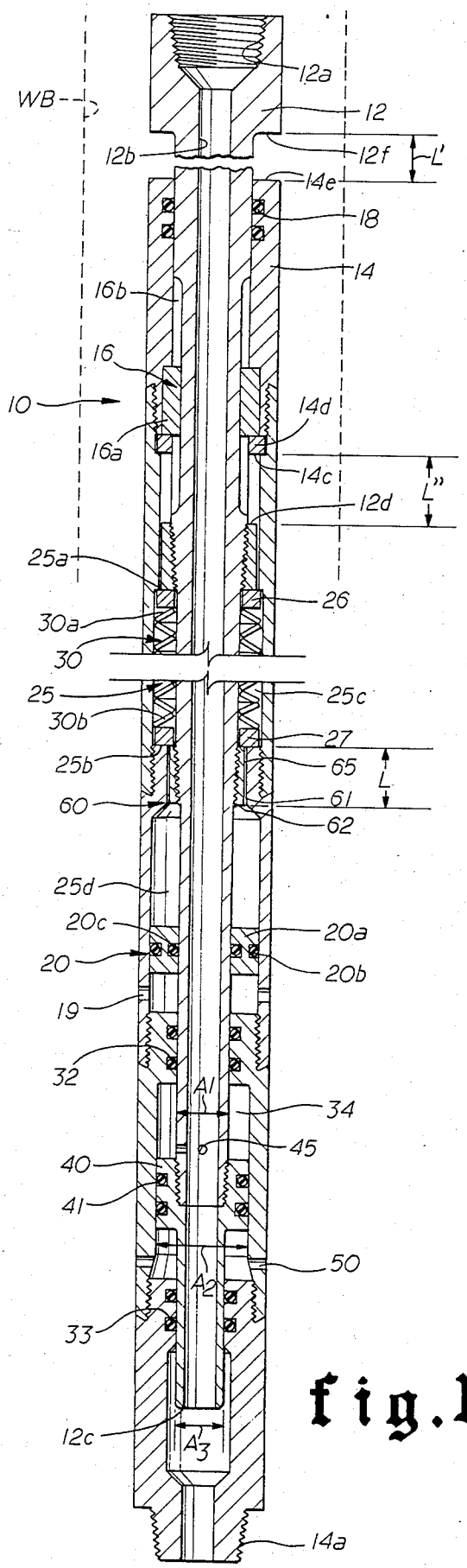
FIG. 1 is a vertical sectional view illustrating a preferred embodiment of the tool.

Attention is first directed to FIG. 1 wherein the shock absorber of the present invention is referred to generally by the numeral 10 and includes an elongated telescopic structure having an inner tubular body or member 12 and an outer housing or tubular member 14. Means 12*a* on the inner body 12 and 14*a* on the outer housing 14 are provided for connecting the telescopic structure in a well drilling string for conducting well drilling fluid therethrough to be discharged into the well bore during drilling operations in a manner well known to those skilled in the art. Drive means 16 are provided between the inner body 12 and outer housing 14, such means comprising the drive keys 16*a* which are supported in the outer housing as illustrated and fit within the longitudinally extending grooves 16*b* in the inner body 12 to accommodate relative longitudinal movement between the inner body 12 and outer housing 14 while inhibiting relative rotation therebetween. Upper seal means 18 are provided between the inner body 12 and outer housing 14 and lower seal means referred to generally at 20 are also provided between the outer housing 14 and inner body 12 to provide a liquid receiving chamber referred to at 25. Resilient means referred to generally at 30 are received within the liquid chamber 25 and surround the innner body 12 a shown. Spaced shoulders 25*a* and 25*b* formed in the chamber 25 on outer housing 14 receive annular seating rings 26 and 27, respectively. One end 30*a* of the resilient means 30 abuts the seating ring 26 and the lower end 30*b* abuts the seating ring 27.

Means are provided to equalize the pressure in the well bore represented by dotted line at WB with the pressure in the liquid receiving chamber 25 and include port means 19 in the outer housing 14 beneath the seal means 20. The seal means 20 forms a movable barrier in that it includes a ring 20*a* having seal means 20*b* which engage the inner wall or surface of the outer housing 14 and seal means 20*c* for engaging the outer surface of the inner body 12 as shown.

The foregoing arrangement conducts drilling fluid through the bore 12*b* of the inner member 12 to be discharged out the lower end 12*c* thereof as previously noted. The fluid pressure exerted against the inner member 12 at the seal means 33 between the inner body 12 and outer housing 14 tends to urge the inner member 12 upwardly or to an extended position relative to the outer housing 14. The present invention provides a means to neutralize the pressure of the drilling fluid acting to move the body 12 upwardly and provides a cooperating surface means on the body and housing that are sealably engaged and which are responsive to the drilling fluid in the structure to urge the body 12 longitudinally downwardly in one direction to counterblance the drilling fluid pressure tending to urge the lower end of body 12 upwardly in the other direction.

In the FIG. 1 form, the means to neutralize includes an additional liquid receiving chamber 34 formed between the spaced upper and lower seals 32 and 33 between the inner body 12 and the outer housing 14. Surface means in the form of a piston 40 provided on the inner body 12 has piston seals 41 which sealably engage the outer housing 12 within chamber 34 a shown in FIG. 1. Port means 45 are provided in the inner body 12 above the seal means 41 on the piston or surface means 40 for conducting drilling fluid passing through the structure to the chamber 34 to act thereon. Port means 50 are provided in the outer housing 14 below the seal means 41 for equalizing the pressure in the well bore with the pressure in the additional chamber 34 beneath the piston means 40.

The effective cross-sectional area of the telescopic structure of the FIG. 1 embodiment at the seal means 32, 41 and 33 responsive to drilling fluid pressure passing therethrough may be represented, respectively, as indicated in FIG. 1 of the drawings by $A_1$, $A_2$ and $A_3$. Such cross-sectional areas can be varied or predetermined so that the cross-sectional area $A_2$ minus the cross-sectional are $A_1$ will equal or substantially approximate the cross-sectional $A_3$. In this event, the effect of the pump pressure acting at the earth's surface and the effect of the pressure of the drilling fluid passing through the inner body 12 of the structure and discharged into the well bore WB will be substantially neutralized or nullified. Thus, the present invention eliminates, or substantially eliminates, the pump pressure effect encountered by prior art devices and enables the present invention to function without regard to the weight which must be carried on the drill string to first overcome the drilling fluid pressure tending to urge inner body 12 upwardly before the invention is operative.

Stop shoulder means are provided in the telescopic structure to limit the extension and contraction between the inner body 12 and outer housing 14. The annular shoulder 12*d* on inner body 12 and the annular shoulder 14*c* on ring 14*d* carried by outer housing 14 are engageable to limit the extension between the inner body 12 and outer housing 14. The shoulders 14*e* and 12*f* on outer housing 14 and inner body 12, respectively, are engageable to limit the contraction of the inner body 12 and the outer housing 14.

It will be noted that the stop shoulder means 12*d*, 12*f* and 14*c*, 14*e* are positioned on the inner and outer members 12 and 14, respectively, outside the fluid receiving chamber 25 so that engagement of such shoulders can be accomplished without interference of fluid flow which may be important when a drilling jar is used in the drill string to impart up and down drilling jar imparts to a stuck drill string as will be described in greater detail.

Cooperating surface means referred to generally at 60 are provided in the liquid receiving chamber 25 to dampen movement between the body and housing and to further dampen shock loads and vibrations imparted to the present invention. The means 60 includes the annular inwardly projecting surface 61 forming a restriction on the outer housing 14 and the enlarged surface 62 on the inner body 12 which are in relatively close, but spaced, relationship to form a restricted annular passage or bore 65 between the surfaces 61 and 62. Thus, as the inner and outer members 12 and 14 contract and extend, restricted liquid displacement will occur between the chamber portion 25*c* above the restricted passage 65 to the chamber portion 25*d* beneath the restricted annular passage 65 and restrict relative movement between body 12 and housing 14 and assist in dampening loads and vibrations applied to the telescopic structure.

The length of enlarged surface 62 represented at L in FIG. 1 is less than the distance between shoulders 12*f*, 14*e* represented at L′ and is less than the distane between shoulders 14*c*, 12*d*, represented at L″, so that when the shoulders 12*f*, 14*e*, or the shoulders 14*c*, 12*d* are engaged, the enlarged surface 62 is above or below surface 61 so that the dampening means is deactivated. This reduces, if not completely eliminates, the likelihood of damage to the shock absorber components when a drilling jar delivers an up or down impact to the drill string in which the present invention is employed.

Figure 2:
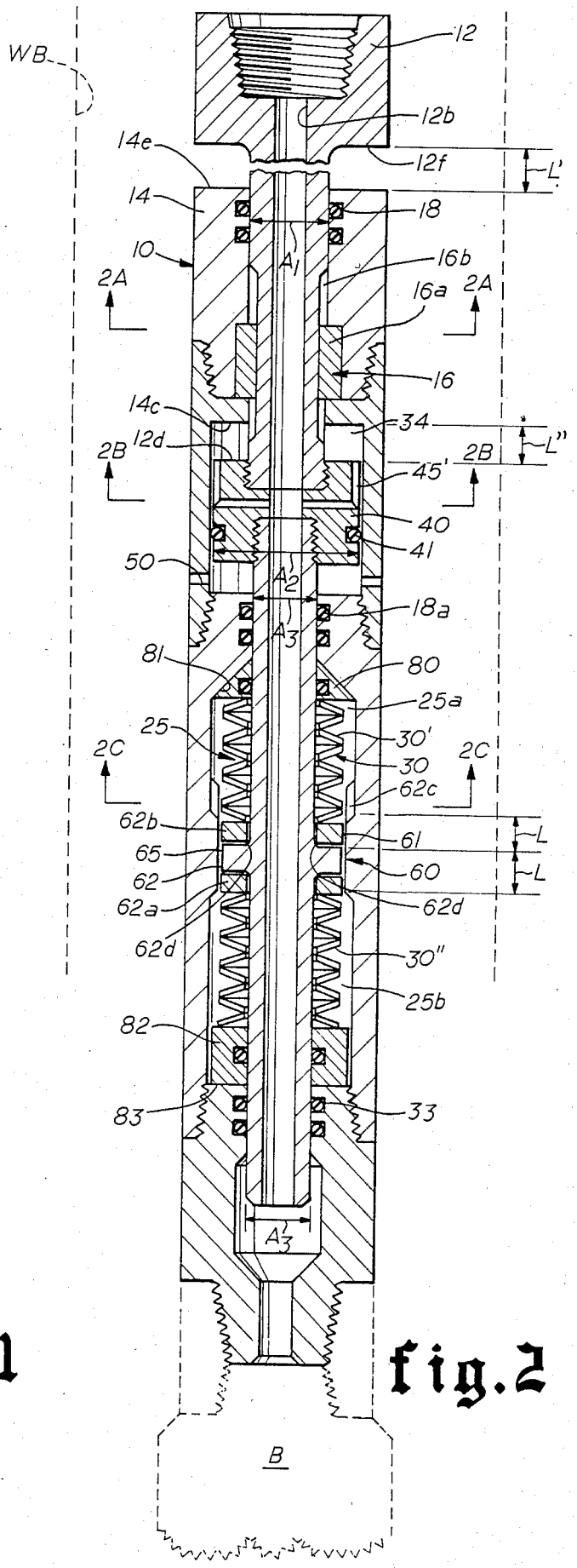
FIG. 2 is a vertical sectional view illustrating an alternate embodiment of the tool.
Figure 2A:
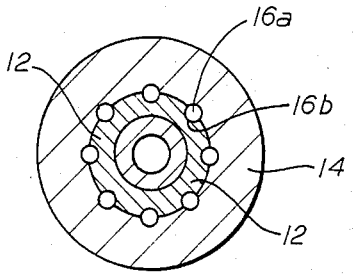
FIGS. 2A; 2B; and 2C are sectional views on the lines 2A—2A; 2B—2B; and 2C—2C illustrating further structural details of the invention.
Figure 2B:
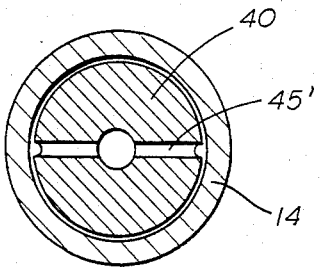
Figure 2C:
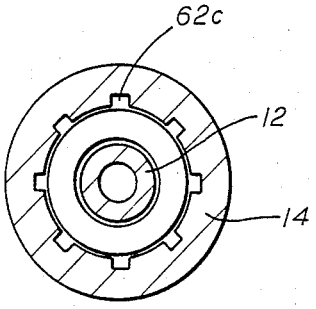

In FIG. 2, an alternate embodiment is illustrated wherein dual resilient means 30′ and 30″ are arranged in liquid recieving chamber 25 formed by seals 18*a* and 33 between body 12 and housing 14. In the FIG. 2 modification, the fluid pressure responsive means comprising piston means 40 is arranged above the liquid receiving chamber 25, whereas, in FIG. 1, it is below liquid receiving chamber 25. The additional liquid receiving chamber 34 in which piston means 40 is received is formed by seals 18*a*, 18 which are spaced and engage between inner body 12 and outer housing 14. The cooperating surface means between the inner and outer members 12, 14 again is shown as being in the form of a piston 40 secured to inner body 12. It is arranged in the chamber 34 and is provided with a port or passage 45′ which communicates with the bore 12*b* of body 12 as shown above piston seal means 41.

Means to equalizing the pressure in chamber 34 with the pressure in the surrounding well bore WB is provided in the form of port means 50 through the outer housing 12 beneath the seal means 41 on piston 40 to communicate well bore fluid to the interior of chamber 34 beneath piston seal means 41.

In the FIG. 1 form, the drive means 16 is received in the liquid receiving chamber 25, whereas in the FIG. 2 form, the drive means 16 is shown as being received within the additional liquid receiving chamber 34 and functions in substantially the same manner as in FIG. 1.

Figure 3:
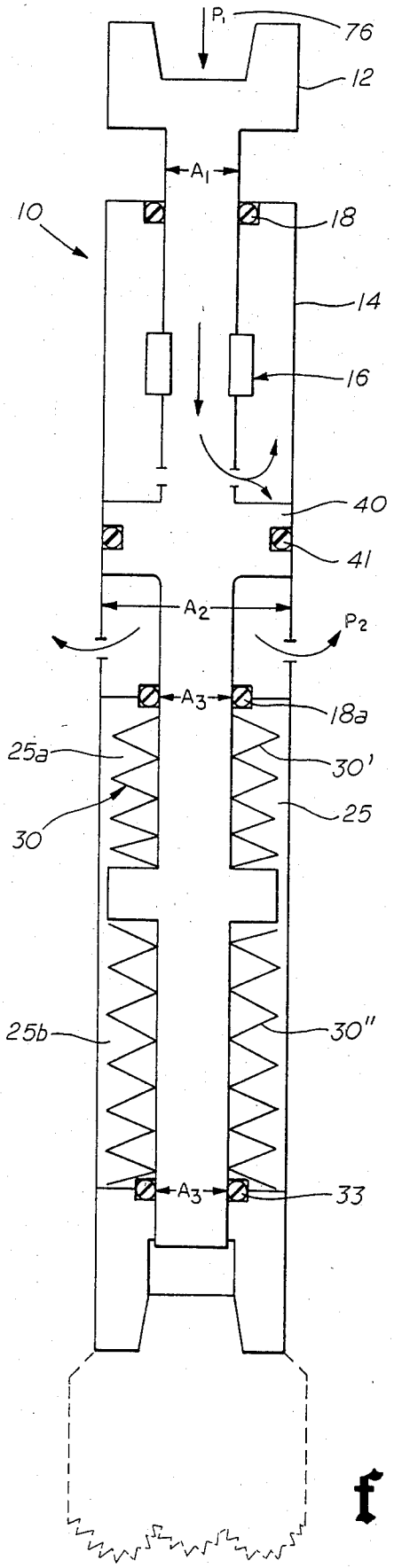
FIG. 3 is a schematic view to demonstrate certain features and advantages of the present invention.

FIG. 3 is a diagrammatic representation of the form of the invention shown in FIG. 2. The pump pressure (and hydrostatic head) is referred to by the designation $P_1$ as illustrated at 76, and the effective cross-sectional areas in the telescopic structure in this form of the present invention responsive to the drilling fluid pressure passing through the structure are represented at $A_1$, at seal 18; $A_2$, at piston seal means 41 on piston 40; and $A_3$ at seal means 33 adacent the lower end of the structure.

In the FIG. 2 form, the effective cross-sectional areas $A_1$, $A_2$ and $A_3$ again can be varied or predetermined so that the pressure acting on cross-sectional area at seal 41 ($A_2$) minus the pressure effective on the area at seal 18 ($A_1$) equals or substantially counterbalances the effective pressure acting at the area of seal 33 ($A_3$). Thus, the fluid pressure acting to urge inner body 12 upwardly within outer housing 14 is neutralized so that the present invention functions independently of pump pressure.

Dampening means referred to generally by the letter 60 are provided in the FIG. 2 modification. Such dampening means are again provided in the liquid receiving chamber 25 which receives the resilient means referred to generally at 30. In this form of the invention, the dampening means 60 is in the form of two separate resilient means 30′ and 30″ and the dampening means is arranged between the separate upper and lower resilient means 30′ and 30″. Such dampening means again consists of an inwardly projecting surface 61 forming a restriction on outer housing 14 and an annular enlargement 62 formed on and extending from inner member 12 to form an annular restricted bore or passage 65. The enlargement 62 also provides a support for the annular rings 62*a* and 62*b* on opposite sides thereof as shown in the drawings. Ring 62*a* abuts the upper end of resilient means 30″ and ring 62*b* abuts and supports the lower end of resilient means 30′, respectively. The upper end of resilient means 30′ abuts conical member 80 seated on annular tapered shoulder 81 adjacent the upper end of chamber 25 and is provided with seals to sealably engage the inner body 12. The lower end of resilient means 30″ abuts ring 82 seated on should 83 at the lower end of chamber 25 which also has seals as shown.

It will be further noted that longitudinally extending, circumferentially spaced slots 62*c* are provided in and extend from the upper end of enlargement 61 into chamber portion 25*a* in which resilient means 30′ is positioned.

Figure 4:
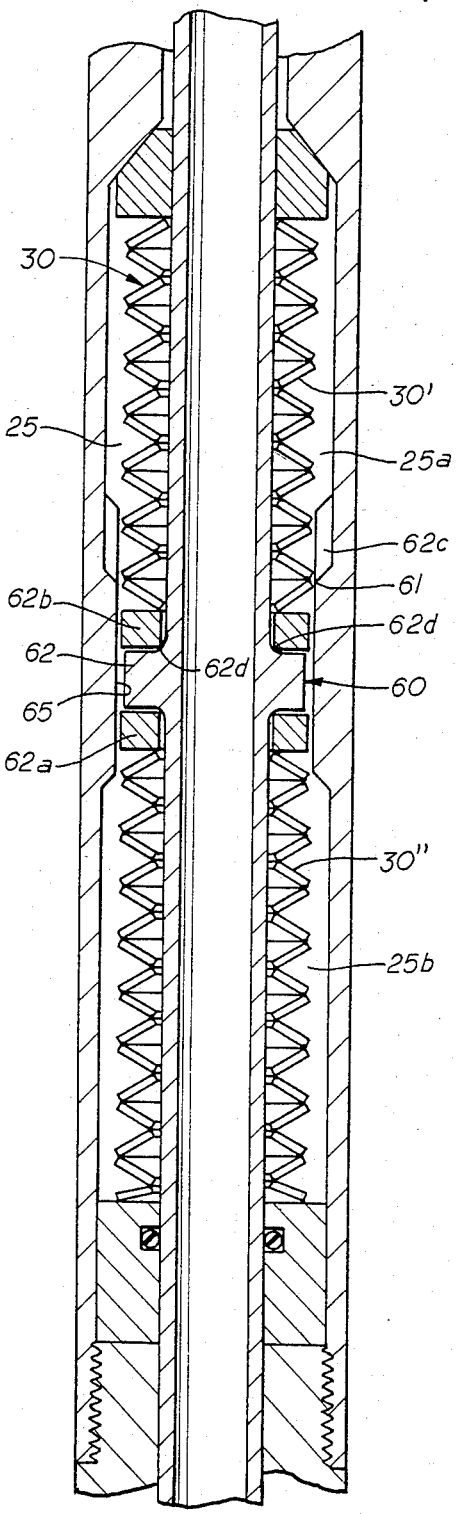
FIG. 4 is an enlarged view of the form of resilient means illustrated in FIG. 2 in greater detail and illustrating in greater detail a dampening arrangement in the liquid receiving chamber in the FIG. 2 form.
Figure 6:
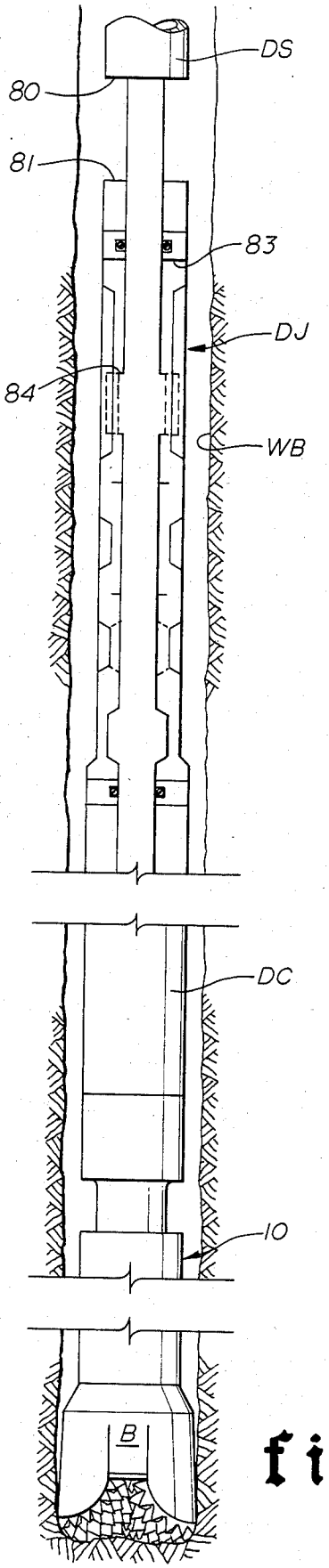
FIG. 6 illustrates the present invention in a drill string with a drilling jar.

When the embodiment of FIG. 2 employing the dampening means 60 illustrated in greater detail in FIG. 4, is used in a drill string and drilling weight is applied through the structure to the bit B, annular projection 62 on member 12 will impart the load to the resilient means 30′ and means 30″ which then resiliently transmits the load to the bit B represented in FIG. 6.

It can be appreciated that the function will be the same with the FIG. 1 modification when the telescopic structure is positioned in the drill string as shown in FIG. 6 of the drawings.

Figure 7:
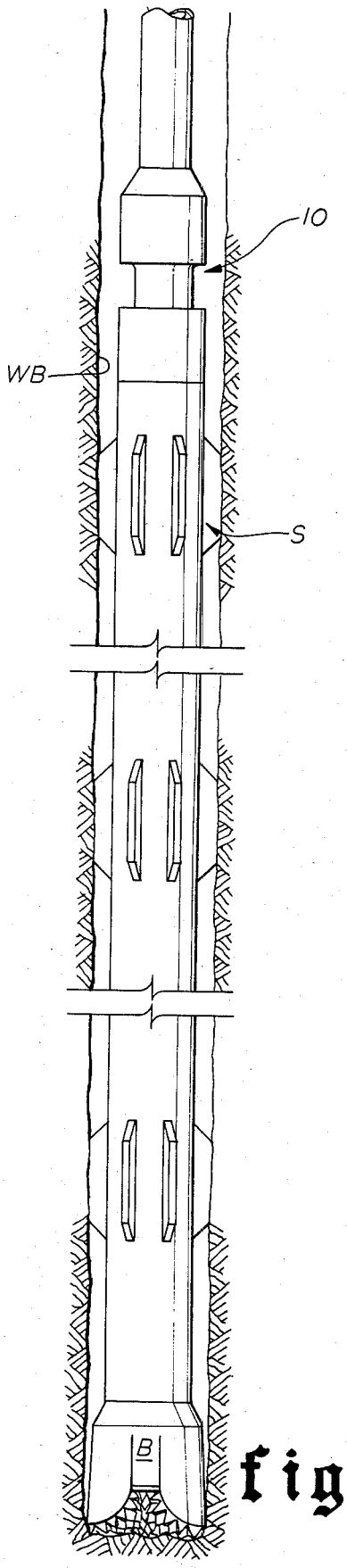

When the telescopic structure with the dampening arrangement 60 illustrated in FIGS. 2 through 4 is placed higher in the bottom hole assembly (relative to the bit as compared with FIG. 6) and as demonstrated in FIG. 7, the upper side of the annular enlargement 62 supports the bottom hole assembly through resilient means 30. FIG. 4 represents how the shock system of the present invention carries the drill load, either in tension or compression, as well as determining how the load is to be carried. That is, the resilient means 30 assists in cushioning the load while the dampening means 60 qualifies, or determines, how the load is carried by the structure. The annular ring members 62*a*, 62*b* on enlargement 62 form a close fit with the inwardly projecting surface 61 forming a restriction on outer housing 14 so as to act as a shock dampening or a shock absorbing means to further dampen the shock loads or vibrations encountered during drilling. Rapid relative movement between body 12 and outer housing 14 causes pressures to rise in liquid receiving chamber 25 until hydraulic bleedoff is accomplished between the annular member 62*b* and inwardly projecting surface 61 forming a restriction on outer housing 14. As up or down jar shock loads are generated, annular member 62*b* is pulled up into slots 62*c* at the upper end of annular inwardly projecting surface 61 forming a restriction on outer housing 14 for fluid bypass from chamber portion 25*a* to chamber portion 25*b*, and thus excessive pressures are relieved in chamber portion 25*a* on an up jar load. Conversely, on a down jar load, weight down causes annular member 62*b* to unseat at 62*d* for liquid bypass to chamber portion 25*a* from chamber portion 25*b*, and excessive pressure is thus relieved in chamber portion 25*b*. Accordingly, moderate loads and shock loads are carried by the system, but overloads have relief when encountered in heavy jarring and vibration operations.

For example, the distances in FIG. 2 represent the length of travel to remove members 62*a*, 62*b* from the restiction formed on outer housing on contraction and extension of body 12 and housing 14. When 62*a*, 62*b* are not within the restriction on housing 14, and with either shoulders 12*f* and 14*e* or 12*d* and 14*c* engaged, the dampening means is disengaged. This permits jarring impacts to be passed through the invention without damage to the components thereof. The distance L' between shoulders 12*f* and 14*e* is greater than the lowermost distance designated L in FIG. 2, so that before shoulders 12*f*, 14*e* engage, the enlargement 62 and ring 62*a* are below, or positioned relative to, surface 61 so that the dampening means is effectively deactivated. Similarly, the distance L'' between shoulders 14*c*, 12*d* is greater than the uppermost distance designated L in FIG. 2 so that before shoulders 14*c*, 12*d* engage, the enlargement 62 and ring 62*b* are above, or positioned relative to, surface 61 so that the dampening means is deactivated.

Some form of hydraulic shock absorption is present in all fluid loaded drilling shock tools. A means of deactivating the hydraulic dampening means is desired during transmission of jarring shock loads so that the hydraulic absorber system will not absorb and neutralize the jarring effort and so that the jar shock load will not rupture or otherwise damage the hydraulic absorbing mechanism. By selectively spacing the upstroke L' with respect to L and L'', the piston dampening means at 60 will be clear of the restricted bore 61 provided L is less than L' and L'' as the jar forces are applied to the tool. Thus, failure of the hydraulic dampening means 60 is avoided during high intensity jarring impact operations either up or down.

Figure 5:
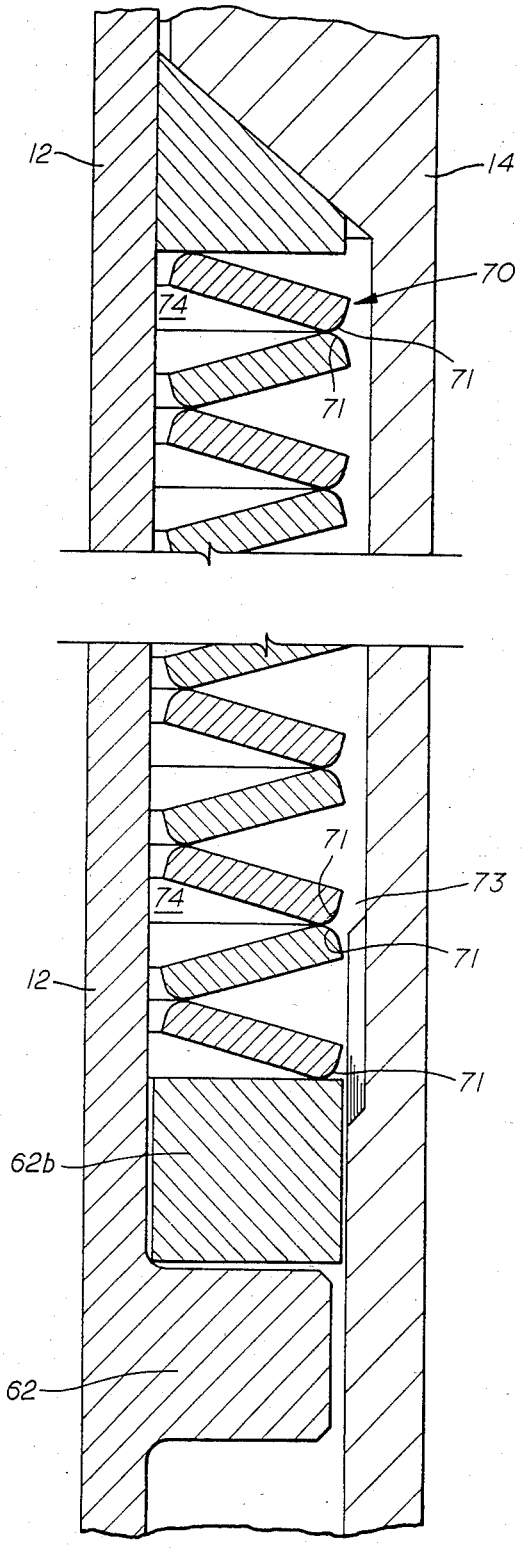
FIG. 5 is an enlargement of a preferred form of resilient means employed with the present invention structured to trap liquid upon contraction and expansion.

FIG. 5 demonstrates how the resilient means 30 may be structured to provide additional desirable load and shock carrying ability. The resilient means 30, 30' and 30'' preferably comprise Belleville springs which are stacked in a manner well known in the art. However, by forming the annular edges of each member in the stack as illustrated at 71 in FIG. 5, the adjacent members cooperate to tend to trap liquid in chamber 25 in the space 74 between the Belleville washers as they are compressed together. The curved, annular edges 71 of adjacent Belleville spring washers remain in contact as the springs are compressed and will retain the liquid in the space 74 on one side of the stacked springs until the liquid pressure forces the curved edges apart for ejection of liquid therefrom into the space 73 on the other side of the stack. This provides both a mechanical and an added hydraulic load carrying ability to the present invention.

The same function occurs when fluid flows from the space 73 to the space 74 since both the inner and outer annular edges of the Belleville springs are provided with a radius of curvature to maintain the stacked springs in contact at their edges during a longer or greater interval of time as they collapse toward each other during loading.

In FIG. 6, the present invention 10 is illustrated as connected to a drill bit B in a well bore WB. Drill collars DC are connectd to the invention 10 and above the drill collars a drilling jar DJ is connected to drill string DC which extends upwardly therefrom to the earth's surface. A hydraulic drilling jar DJ is schematically represented which is well known to those skilled in the art. The details of the drilling jar DJ are not pertinent to the present invention except that some type of engaging means, mechanical or hydraulic, is normally employed in a drill string DS to enable either a tension or compression load to be developed in the drill string for selectively applying an up drilling jar impact and/or a down drilling jar impact to the drill string when it becomes stuck to try to free it. If a compression load is developed by the drill jar in the drill string when the jar engaging means is released, the drill string then moves down rapidly to impact the shoulders 80 and 81 as shown in FIG. 6 for applying a down jar impact to the drill string DS including the shock absorber 10 of the present invention. Similarly, when an up jar is to be applied, the mechanical or hydraulic engaging mechanism is again activated in a manner well known to those skilled in the art, and when released, shoulder means represented at 83, 84 as shown in FIG. 6 impact to impart an up drilling jar to the drill string which includes the present invention in an endeavor to release the stuck drill string. It can be appreciated that these loads are substantial, and in many instances the drilling jar impact destroys or damages mechanisms in the drill strings including the connections or shock absorbing devices.

The present invention includes means to deactivate the shock absorber of the present invention in that the spacing of the stop shoulder means on the inner member 12 and outer housing 14 in the FIG. 1 and FIG. 2 form is such that they will engage before a drilling jar blow is delivered to the well string.

For example, the spacing of shoulders 12*f* and 14*e* on inner body 12 and outer housing 14, respectively, is such that these shoulders will engage and thus deactivate the shock absorbing arrangement of the present invention before the down jar shoulders 80 and 81 of the drilling jar DJ impact due to a compression load applied at the earth's surface to the drill string to impart a substantial down drilling jar impact blow to the drill string. Similarly, the shoulders 12*d*, 14*c* on body 12 and housing 14 engage before the surfaces 83, 84 on the drilling jar impact due to tension in the drill string to deliver an up jar to the drill string DS. Shoulder engagement of the body 12 and housing 14 as above stated deactivates the shock absorber of the present invention and enable substantial drilling jar impacts to be delivered therethrough without damaging or destroying the components of the shock absorber of the present invention.

More specifically, the engagement of shoulders 12*f* and 14*e* deactivates the present invention against further compressive loads in that no further relative movement may occur between the inner body 12 and outer housing 14 so that damage to the internal components of the shock absorber are substantially minimized, if not completely eliminated. Similarly, when shoulders 12*d* and 14*c* engage, the present invention is protected against internal damage due to impact of up drilling jar loads.

Further, it will be noted that the stop shoulder means on inner body 12 and outer housing 14 of the present invention are both outside the liquid receiving chamber 25. Thus, there is no fluid flow impediment as the stop shoulder means on inner body 12 and outer housing 14 are moved to engage and deactivate the shock absorber as above described.

When it is desired to use the present invention in the down load position, it is preferable that it be placed just above the bit (as shown in FIG. 6) in the drill string which generally generates most of the shock loads as it encounters difficult formations to be drilled, particularly in large diameter shallow holes. Since the present invention provides an arrangement to neutralize the effect of drilling fluid, the present invention is functional even in those situations where the pressure on the inner member with prior art arrangements would require a substantial weight in the drill string to even render the shock absorber operative.

As the hole gets deeper, more weight may be added to the bit as well as stabilizers and hole reamers may under some circumstances be essential or at least desirable for hole control and pentration rate. Since the extra bit weight and the additional devices added to the bottom hole assembly also generate additional shock and mechanical forces, it is therefore advantageous in some instances to place the present invention above these tools as illustrated in FIG. 7 so that the shock forces they develop, in addition to bit shock loads, may be absorbed and dissipated before their destructive nature can propagate up into the upper drill string and to the surface drilling equipment.

When used in this manner, the invention illustrated in FIGS. 1 and 2 may be in the up load position as indicated in such views.

However, in either the up load or down load position, the drill string DS may become stuck either above or below the shock tool 10. In either of these cases, the present invention is capable of transmitting shock release loads generated by mechanical or hydraulic drilling jars DJ placed in the string for release purposes. As noted previously, under sever shock release loads, the device of the present invention assumes a position so as to transmit the release shock forces without damage to the nominal shock absorption features of the present invention or without absorption of an undue amount of the high shock release loads to be transmitted to the stuck point below the tool. Drilling shock loads are many times less than the high intensity jar release impact loads.

The foregoing disclosure and description of the invention are illustrative and explanatory thereof, and various changes in the size, shape and materials as well as in the details of the illustrated construction may be made without departing from the spirit of the construction may be made without departing from the spirit of the invention.

What is claimed is:

1. In a shock absorber for use in a well drilling string in a well bore having a drilling jar formed by inner and outer members with up and down jar impact faces engageable to engage and deliver an up or down jar impact to the well string when it is stuck and wherein the shock absorber includes an elongated telescopic structure having an inner tubular body and an outer housing with means for connecting the structure in a well drilling string for conducting drilling fluid therethrough, the structure further having rotary drive means between the body and the housing and resilient means engageable between the body and housing to cushion telescopic contraction and extension of the inner body and outer housing forming the structure, the invention including:

means to substantially neutralize the effect of well drilling fluid on the body;

seal means in longitudinally spaced relation between the body and housing to provide a liquid receiving chamber in which the resilient means is recieved;

extension and contraction stop shoulder means on the body and housing to limit longitudinal extension and contraction therebetween, said shoulder means being formed on the body and housing outside the liquid receiving chamber;

said extension stop shoulder means being longitudinally spaced on the body and housing to engage and prevent further extension of the body and housing before the up drilling jar impact faces engage to deliver an up jar by a pull on the well string, and said contraction stop shoulder means being spaced to engage and prevent further contraction of the body and housing before the down drilling jar impact faces engage to deliver a down jar by pushing on the well string so as to inhibit damage to the structure of the shock absorber during jarring blows to the stuck well string by the drilling jar.

2. The invention of claim 1 including means in the chamber to dampen longitudinal extension and contraction between the body and housing in response to loads and vibrations encountered during drilling.

3. The invention of claim 1 wherein said resilient means is formed by annular, stacked Belleville spring elements, said elements having their contacting surfaces formed to restrain the flow of liquid from within the stacked elements when the telescopic structure contacts and extends to further assist in cushioning extension and contraction of the structure in response to loads and vibrations.

4. The invention of claims 1, 2 or 3 wherein said resilient means is a single resilient member.

5. The invention of claims 1, 2 or 3 wherein said resilient means is a pair of resilient members spaced longitudinally in the chamber.

6. The invention of claim 1 wherein said means to neutralize includes surface means on the inner body and responsive to drilling fluid as it is conducted through the structure to urge the body downwardly to counterbalance the pressure of drilling fluid tending to urge the body upwardly.

7. The invention of claim 6 including port means in the housing to equalizing the pressure in the well bore with the pressure in the housing on one side of said piston means.

8. The invention of claim 1 wherein said means to substantially neutralize includes piston means on the body with piston seal means sealingly engaging the housing, spaced seal means between the body and housing to provide a piston chamber, port means in the body above said piston seal means for conducting drilling fluid passing through the structure to the piston chamber to urge said piston means and the body downwardly relative to the housing to counterbalance the pressure of the drilling fluid in the structure tending to urge the body upwardly.

9. The invention of claim 8 including port means in the housing to equalizing the pressure in the well bore with the pressure in the piston chamber on one side of said piston means.

10. The invention of claim 1 wherein one of said seal means forming the liquid receiving chamber includes seal means movable longitudinally between the body and housing.

11. The invention of claim 10 wherein equalizing means are provided in the structure to equalize the pressure in the well bore with the pressure in the liquid receiving chamber.

12. The invention of claim 11 wherein said equalizing means includes longitudinally movable seal means between the body and housing, and port means in the housing to conduct well bore fluid to act on said movable seal means.

13. In a shock absorber for use in a well drilling string in a well bore having a drilling jar formed by inner and outer members with up and down jar impact faces engageable to engage and deliver an up or down jar impact to the well string when it is stuck and wherein the shock absorber includes an elongated telescopic structure having an inner tubular body and an outer housing with means for connecting the structure in a well drilling string for conducting drilling fluid therethrough, the structure further having rotary drive means between the body and the housing for resilient means engageable between the body and housing to cushion telescopic contraction and extension of the inner body and outer housing forming the structure, the invention including:

means to substantially neutralize the effect of well drilling fluid on the body;

seal means in longitudinally spaced relation between the body and housing to provide a liquid receiving chamber in which the resilient means is received;

means in the chamber to dampen shock and vibration loads imparted to the structure during drilling; and means to deactivate said dampening means when the drilling jar delivers up or down jar impacts to the well string.

14. The invention of claim 13 wherein said means to dampen includes cooperating surface means on the body and housing forming liquid restriction means in the chamber to restrict the flow of liquid therearound upon relative movement of the body and housing in response to shock loads and vibrations imparted thereto.

15. The invention of claim 13 wherein said means to deactivate includes extension and contraction stop shoulder means on the body and housing engageable to prevent further extension or contraction before the impact jar faces of the drilling jar engage to thereby inhibit damage to the shock absorber while the drilling jar is actuated.

16. The invention of claim 13 wherein one of said seal means forming the liquid receiving chamber includes seal means movable longitudinally between the body and housing.

17. The invention of claim 13 wherein equalizing means are provided in the structure to equalize the pressure in the well bore with the pressure in the liquid receiving chamber.

18. The invention of claim 17 wherein said equalizing means includes longitudinally movable seal means between the body and housing, and port means in the housing to conduct well bore fluid to act on said movable seal means.

* * * * *